US005841356A

United States Patent [19]

Woodruff et al.

[11] Patent Number: 5,841,356

[45] Date of Patent: Nov. 24, 1998

[54] APPLIANCE SAFETY ALARM

[76] Inventors: James Woodruff; Elizabeth Woodruff, both of 279 Mt. Moriah Rd., Auburn, Ga. 30203

[21] Appl. No.: 783,278

[22] Filed: Jan. 15, 1997

[51] Int. Cl.[6] ..... G08B 21/00; H05B 1/02

[52] U.S. Cl. ..... 340/635; 340/542; 340/644; 219/506

[58] Field of Search ..... 340/635, 525, 340/540, 545, 644, 568, 679, 542, 501; 34/526, 534, 572, 88; 219/506, 518, 10.55 B

[56] References Cited

U.S. PATENT DOCUMENTS

| | | | |
|---|---|---|---|
| 3,399,461 | 9/1968 | Doty | 34/45 |
| 4,106,095 | 8/1978 | Yarbrough | 340/870.05 |
| 4,132,008 | 1/1979 | Deschaaf | 34/45 |
| 4,345,145 | 8/1982 | Norwood | 219/506 |
| 4,415,887 | 11/1983 | Kawase | 340/635 |
| 4,453,161 | 6/1984 | Lemelson | 340/542 |
| 4,785,152 | 11/1988 | Hirata et al. | 219/506 |
| 5,077,547 | 12/1991 | Burgmann | 340/501 |
| 5,229,753 | 7/1993 | Berg et al. | 340/679 |
| 5,467,077 | 11/1995 | Wunderlich et al. | 340/635 |
| 5,497,563 | 3/1996 | Mayfield | 34/572 |
| 5,608,378 | 3/1997 | McLean et al. | 340/635 |

*Primary Examiner*—Brent A. Swarthout
*Assistant Examiner*—Van T. Trieu
*Attorney, Agent, or Firm*—Joseph N. Breaux

[57] ABSTRACT

An appliance safety alarm including a first sensing circuit for detecting operation of the appliance, a second sensing circuit for detecting when an access cover, such as a dryer door or washer lid, is in the open condition, and a control circuit having first and second inputs in connection with the first and second sensing circuits and having an output controlling an audible alerting device. The control circuit is constructed in a manner to provide an activation signal to the audible alerting device when the access cover is opened while the appliance is in operation and when the access cover remains open for more than a predetermined period when the appliance is not in operation.

7 Claims, 3 Drawing Sheets

APPLIANCE SAFETY ALARM

TECHNICAL FIELD

The present invention relates to safety alarms and more particularly to an alarm device connectable to an appliance such as a washer or dryer that includes a first sensing circuit for detecting operation of the appliance, a second sensing circuit for detecting when an access cover, such as a dryer door or washer lid, is in the open condition, and a control circuit having first and second inputs in connection with the first and second sensing circuits having an output controlling an audible alerting device. The control circuit is constructed in a manner to provide an activation signal to the audible alerting device when the access cover is opened while the appliance is in operation and when the access cover remains open for greater than a predetermined time period when the appliance is not in operation.

BACKGROUND OF THE INVENTION

Each year many small children are injured by home appliances such as dryers and washing machines when the child crawls into the laundry compartment of the appliance. It would be a benefit, therefore, to have an alarm device that could be installed in connection with an appliance that would provide an audible alarm when the appliance access cover is opened while the appliance is in operation. In addition, to deter children from playing with the access cover of these appliances, it would be a further benefit to have an alarm device that could be installed in connection with the appliance that would provide an audible alarm when the alarm device detected the access cover remaining in an open position for greater than a predetermined time period.

SUMMARY OF THE INVENTION

It is thus an object of the invention to provide an appliance safety alarm that can be installed in connection with an appliance that provides an audible alarm when the appliance access cover is opened while the appliance is in operation.

It is a further object of the invention to provide an appliance safety alarm that can be installed in connection with the appliance that would provides an audible alarm when the alarm device detects the access cover remaining in an open position for greater than a predetermined time period.

It is a still further object of the invention to provide an appliance safety alarm that accomplishes both of the above objects in combination.

Accordingly, an appliance safety alarm device is provided. The alarm device comprises a first sensing circuit for detecting operation of the appliance, a second sensing circuit for detecting when an access cover, such as a dryer door or washer lid, is in the open condition, and a control circuit having first and second inputs in connection with the first and second sensing circuits having an output controlling an audible alerting device. The control circuit is constructed in a manner to provide an activation signal to the audible alerting device when the access cover is opened while the appliance is in operation and when the access cover remains open for more than a predetermined period when the appliance is not in operation.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

DESCRIPTION OF THE EXEMPLARY EMBODIMENT

Figure 1:
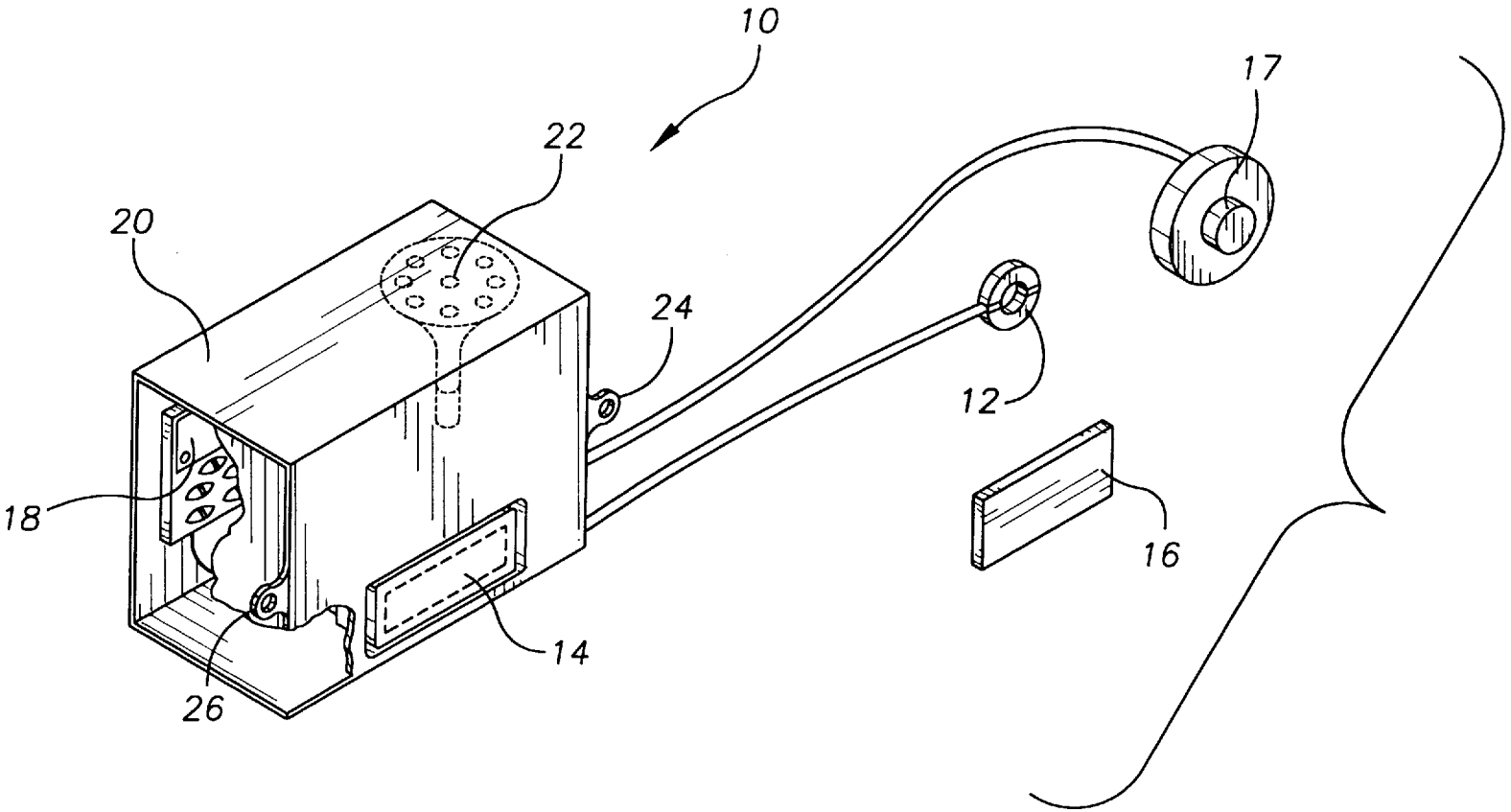
FIG. 1 is a perspective view of an exemplary embodiment of the appliance safety alarm of the present invention showing the alarm housing, the reed switch, the inductive pickup coil, and the remote on/off switch.

FIG. 1 shows an exemplary embodiment of the appliance safety alarm of the present invention generally designated by the numeral 10. In this embodiment, safety alarm 10 includes comprises a first sensing circuit for detecting operation of the appliance that includes a inductive pickup coil 12; a second sensing circuit for detecting when an access cover is in the open condition that includes a magnetically actuated reed switch 14 and a permanent magnet 16; an on/off switch 17; and a control circuit 18 housed within an alarm housing 20 having first and second inputs in connection with the first and second sensing circuits and having an output controlling an audible alerting device 22 also housed within alarm housing 20. Alarm housing 20 is molded from plastic and includes a first and a second mounting bracket 24,26, extending from opposed sidewalls thereof, and a number of sound apertures 28 provided above audible alerting device 22 to allow the audible alarm generated by alarm alerting device 22 to escape from alarm housing 20. In this embodiment audible alerting device 22 is a conventional battery powered buzzer.

Figure 2:
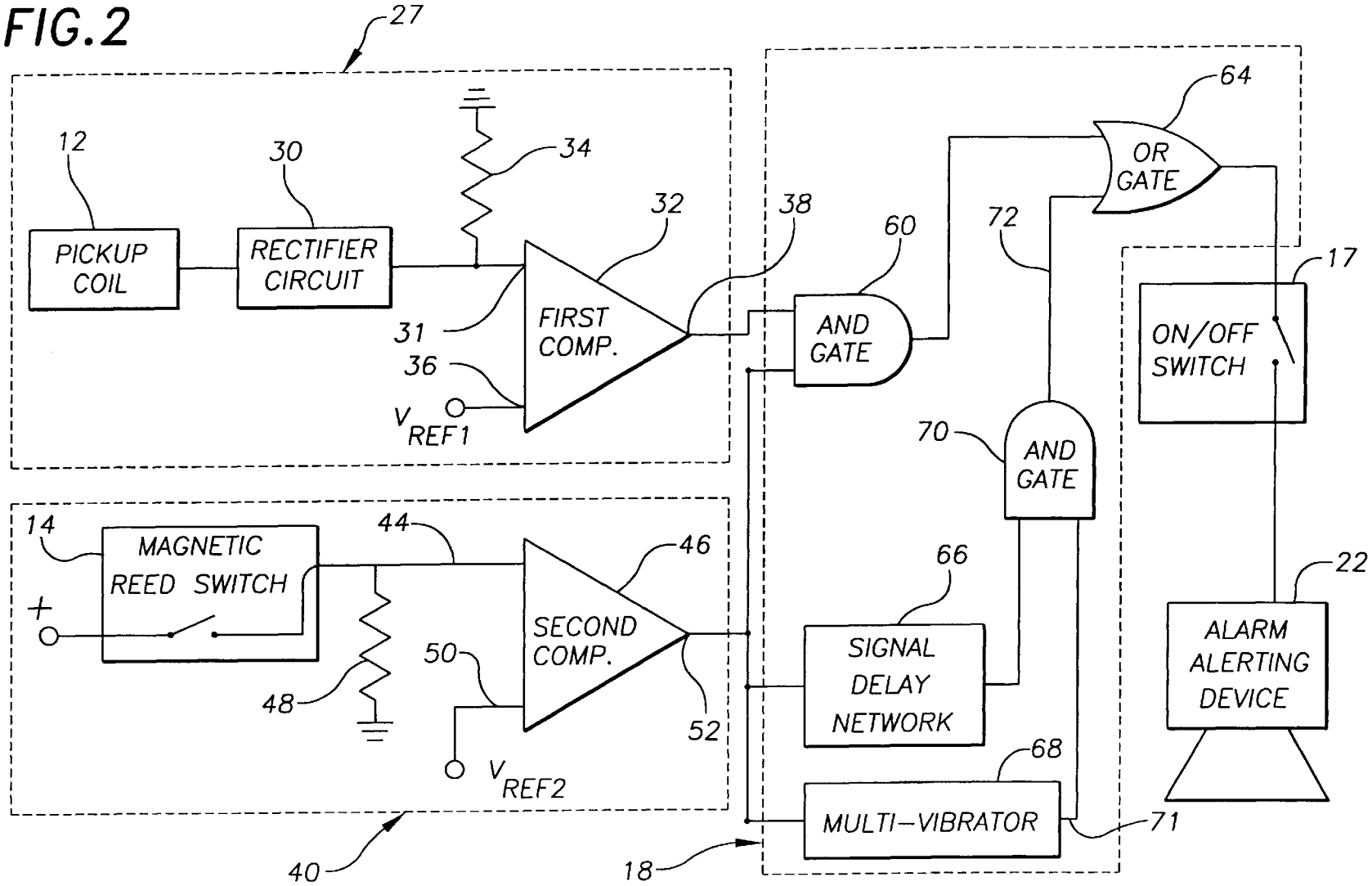
FIG. 2 is a schematic diagram of the first sensing circuit, the second sensing circuit, the control circuit and the alarm alerting device.

With reference to FIG. 2, the first sensing circuit, generally referred to by the numeral 27 detects when the appliance is in operation. This is accomplished by positioning inductive pickup coil 12 adjacent to the power supply lines to the motor of the appliance. When the appliance motor is in operation, current passing through the motor power supply line induces a current in inductive pickup 12 that is rectified by a rectifier circuit 30 providing a rectified coil signal that is then fed to a first signal input 31 of a first comparator 32. A resistor 34 in connection between first signal input 31 and ground to maintain first signal input 31 below the first reference voltage applied to first reference input 36 of first comparator 32. When the voltage applied to first signal input 31 is greater than the first reference voltage, first comparator provides a high first sensed output signal at First comparator output 38. Otherwise, first comparator output 38 provides a low first sensed output signal.

The second sensing circuit, generally referred to by the numeral 40 includes a magnetic reed switch 14 that is positioned adjacent to the access cover of the appliance in which safety alarm 10 is installed. Magnet 16 is positioned onto the access cover at a location selected such that when the access cover is closed magnet 16 is positioned close enough to reed switch 14 to close the contacts of reed switch 14 and when the access cover is opened, the contacts of reed switch 14 open. One terminal of reed switch 14 is connected to a positive voltage, toe other terminal is connected to a second signal input 44 of a second comparator 46. A second resistor 48 is connected between second signal input 44 and ground. A second reference voltage is connected to a second reference input 50. When the contacts of reed switch 14 are closed, signaling a closed access cover, the voltage supplied to second signal voltage input 44 is greater than second reference voltage and second comparator 46 outputs a low voltage at a second comparator output 52. When the contacts of reed switch 14 are open, signaling a closed access cover, the voltage supplied to second signal voltage input 44 is less than second reference voltage and second comparator 46 outputs a high voltage at second comparator output.

First comparator output 38 and second comparator output 52 are logically ANDED by an AND logic gate 60. The first AND output provides a control output signal immediately activating alarm alerting device 22 through an OR logic gate 64 and on/off switch 17. When on/off switch 17 is open the activation signal is blocked from reaching alarm alerting device 22. When on/off switch 17 is closed, the activation signal passes through on/off switch 17 and alarm alerting device 22 is immediately activated and outputs an audible alarm.

Second comparator output 52 is also connected to a signal delay network 66 and a non-retriggerable monostable multi-vibrator 68 having a timing network selected to provided the desired predetermined delay period for delaying before activating audible alarm device 22 after detecting an open access cover. Non-retriggerable monostable multi-vibrator 68 is triggered by a rising edge. The output of signal delay network 66 and the inverted output 71 of non-retriggerable monostable multi-vibrator 68 are logically ANDed by a second AND logic gate 70. A second AND gate output 72 is connected to alarm alerting device through OR gate 64 and on/off switch 17. Signal delay network 66 delays receipt by second AND gate 70 of the signal from second comparator output 52 until the inverted output 71 of non-retriggerable monostable multi-vibrator 68 has beer received by second AND gate 70. Once the timing period for non-retriggerable monostable multi-vibrator 68 has passed the inverted output becomes high and if second comparator output is also high, the output of second AND gate 70 becomes high generating a control output signal activating alarm alerting device 22 after the predetermined delay controlled by the timing period of non-retriggerable monostable multi-vibrator 68. Use of a non-retriggerable monostable multi-vibrator provides an easily adjusted time delay as a variable resistor can be included in the RC network used to select the timing period either at the manufacturing facility of by the end user.

Figure 3:
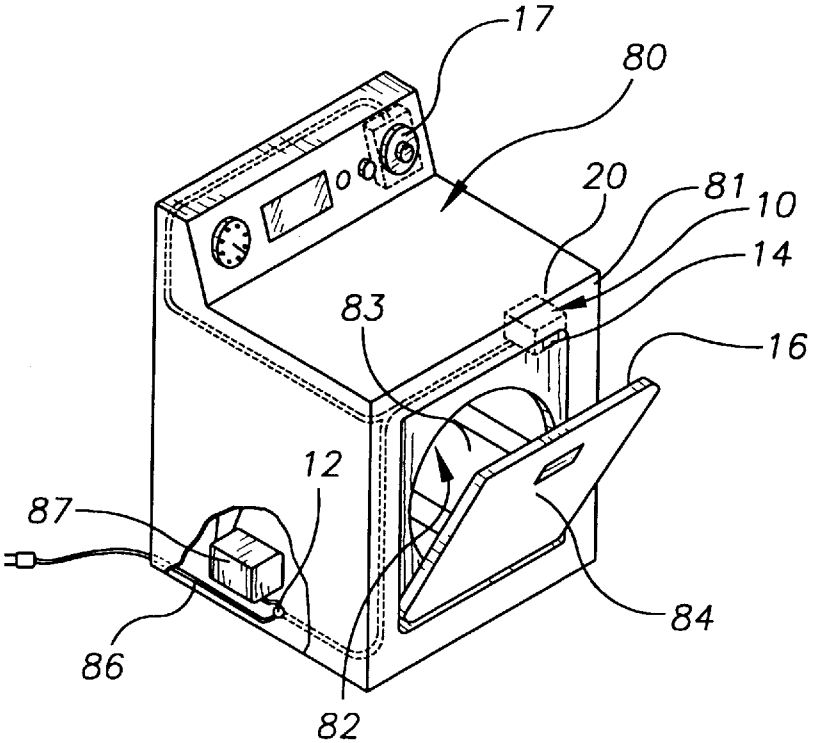
FIG. 3 is a perspective view showing the appliance safety alarm of FIG. 1 installed in connection with a representative clothes dryer.

FIG. 3 shows appliance safety alarm 10 installed in a representative clothes dryer, generally designated by the numeral 80. Clothes dryer 80 includes a dryer housing 81 enclosing a clothes tumbling chamber 82 defined by a tumbling drum 83. Clothes tumbling chamber 82 is accessible through an access opening sealable by a dryer door 84. Tumbling drum 83 is powered by an electric motor 87 connected to electrical power through a power chord 86. Appliance safety alarm 10 is installed by mounting alarm housing 20 within dryer housing 81 in a manner such that reed switch 14 is exposed adjacent the access opening of clothes tumbling chamber 82. Permanent magnet 16 is then secured to dryer door 84 at a location selected such that reed switch 14 is closed by magnetic forces from permanent magnet 16 when dryer door 82 is in the closed position and permanent magnet 16 is moved away from reed switch 14 a sufficient distance to allow reed switch 14 to pen when dryer door 84 is open.

Inductive coil 12 is then secured around power chord 86 and on/off switch 17 placed in a convenient location, preferably at a location out of reach of small children. Appliance safety alarm 10 is then placed into the on state by activating on/off switch 17. Operation of appliance alarm 10 is then as previously discussed.

Figure 4:
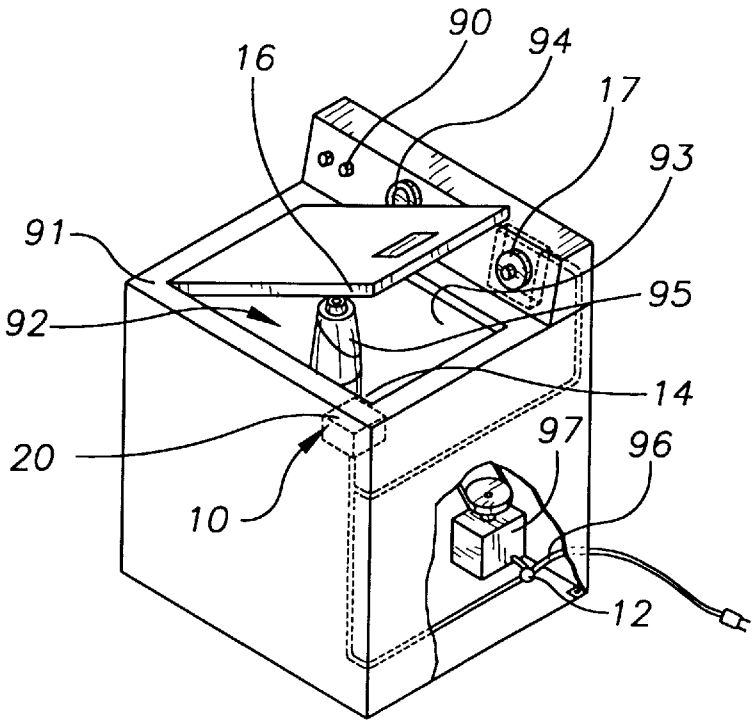
FIG. 4 is a perspective view showing the appliance safety alarm of FIG. 1 installed in connection with a representative washing machine.

FIG. 4 shows appliance safety alarm 10 installed in a representative clothes washing machine, generally designated by the numeral 90. Clothes washing machine 90 includes a washer housing 91 enclosing a clothes washing chamber 92 defined by a washing drum 93. Clothes washing chamber 92 is accessible through an access opening sealable by a washer lid 94. A washing agitator 95 extends within clothes washing chamber 92 and is powered by an electric motor 97 connected to electrical power through a power chord 96. Appliance safety alarm 10 is installed by mounting alarm housing 20 within washer housing 91 in a manner such that reed switch 14 is exposed adjacent the access opening of clothes washing chamber 92. Permanent magnet 16 is then secured to washer lid 94 at a location selected such that reed switch 14 is closed by magnetic forces from permanent magnet 16 when washer lid 94 is in the closed position and permanent magnet 16 is moved away from reed switch 14 a sufficient distance to allow reed switch 14 to open when washer lid 94 is open.

Inductive coil 12 is then secured around power chord 96 and on/off switch 17 placed in a convenient location, preferably at a location out of reach of small children. Appliance safety alarm 10 is then placed into the on state by activating on/off switch 17. Operation of appliance alarm 10 is then as previously discussed.

It can be seen from the preceding description that an appliance safety alarm has been provided that can be installed in connection with an appliance, that provides an audible alarm when the appliance access cover is opened while the appliance is in operation; and that provides an audible alarm when the alarm device detects the access cover remaining in an open position for greater than a predetermined time period.

It is noted that the embodiment of the appliance safety alarm described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An appliance safety alarm comprising:

a first sensing circuit for detecting operation of the appliance, said first sensing circuit including an inductive coil positionable adjacent to a power supply cord of an appliance, said first sensing circuit generating a first sensed output signal responsive to a coil output signal, said first sensed output signal having a first value when said coil signal output indicates operation of an appliance and a second value when said coil signal output indicates non-operation of an appliance;

a second sensing circuit including a magnetically actuated reed switch and a permanent magnet, said reed switch and said permanent magnet being positionable in relation to an access cover of an appliance in a manner such that the position of the access cover effects the state of the reed switch, said second sensing circuit generating a second sensed output signal responsive to a reed switch output signal, said second sensed output signal having a third value when said reed switch output signal indicates a closed access cover and a fourth value when said reed switch output signal indicates an open access cover;

a control circuit having a first control input responsive to said first sensed output signal, a second control input responsive to said second sensed output signal, and a control circuit output generating a control output signal responsive to said first and second control inputs; and an audible alerting device responsive to said control output signal of said control circuit;

said control circuit generating a control output signal activating said audible alerting device after receiving a said first sensed output signal having said second value and a second sensed output signal having said fourth value for a continuous first predetermined delay period.

2. The appliance safety alarm of claim 1 wherein:

said control circuit generates a control output signal activating said audible alerting device immediately upon receiving a said first sensed output signal having a first value and a second sensed output signal having a fourth value.

3. The appliance safety alarm of claim 2 wherein:

said first sensing circuit further includes a rectifier circuit and a comparator circuit;

said coil output signal is rectified by said rectifier circuit to create a rectified coil signal; and said rectified coil signal is fed into an input of said comparator circuit.

4. The appliance safety alarm of claim 1 wherein:

said control circuit includes an AND logic gate, a monostable multi-vibrator circuit having an output in connection with a first logic gate input of said AND logic gate, and a delay network having an delay network output in connection with a second logic gate input of said AND logic gate; and said predetermined delay is controlled by said monostable multi-vibrator.

5. The appliance safety alarm of claim 4 wherein:

said control circuit generates a control output signal activating said audible alerting device immediately upon receiving a said first sensed output signal having a first value and a second sensed output signal having a fourth value.

6. The appliance safety alarm of claim 4 wherein:

said first sensing circuit further includes a rectifier circuit and a comparator circuit;

said coil output signal is rectified by said rectifier circuit to create a rectified coil signal; and said rectified coil signal is fed into an input of said comparator circuit.

7. The appliance safety alarm of claim 6 wherein:

said control circuit generates a control output signal activating said audible alerting device immediately upon receiving a said first sensed output signal having a first value and a second sensed output signal having a fourth value.

* * * * *